US008574037B2

(12) United States Patent
Kresge

(10) Patent No.: US 8,574,037 B2
(45) Date of Patent: Nov. 5, 2013

(54) MULTI-PURPOSE EXTENDED REACH TOOL

(76) Inventor: David W. Kresge, Northford, CT (US)

( * ) Notice: Subject to any disclaimer, the term of this patent is extended or adjusted under 35 U.S.C. 154(b) by 229 days.

(21) Appl. No.: 13/157,972

(22) Filed: Jun. 10, 2011

(65) Prior Publication Data

US 2011/0306283 A1 Dec. 15, 2011

Related U.S. Application Data

(60) Provisional application No. 61/397,383, filed on Jun. 11, 2010.

(51) Int. Cl.
*B24B 23/02* (2006.01)

(52) U.S. Cl.
USPC ..... 451/344; 451/450

(58) Field of Classification Search
USPC ..... 451/344, 359, 358, 450, 111, 488, 354
See application file for complete search history.

(56) References Cited

U.S. PATENT DOCUMENTS

| | | | | |
|---|---|---|---|---|
| 1,971,790 | A * | 8/1934 | Mall | 451/359 |
| 2,910,711 | A | 11/1959 | Mizelle | |
| 3,583,383 | A * | 6/1971 | Ovshinsky | 125/20 |
| 4,168,559 | A | 9/1979 | Henson | |
| 4,238,866 | A | 12/1980 | Taylor | |
| 4,622,780 | A * | 11/1986 | Tingley | 451/41 |
| 4,958,397 | A | 9/1990 | Ryan | |
| 5,386,942 | A | 2/1995 | Dietle | |
| 5,573,024 | A | 11/1996 | DeVaney et al. | |
| 5,819,354 | A | 10/1998 | Alonso et al. | |
| 6,257,256 | B1 | 7/2001 | Fischer | |
| 2004/0064909 | A1 | 4/2004 | Locklear | |
| 2008/0104780 | A1 | 5/2008 | Dayton et al. | |
| 2008/0189870 | A1 | 8/2008 | Dayton et al. | |
| 2008/0216869 | A1 | 9/2008 | Dayton et al. | |
| 2008/0250570 | A1 | 10/2008 | Dayton et al. | |
| 2009/0255071 | A1 | 10/2009 | Jones | |

* cited by examiner

*Primary Examiner* — Robert Rose
(74) *Attorney, Agent, or Firm* — O'Shea Getz P.C.

(57) ABSTRACT

An apparatus adapted to be coupled to a power source having a rotary drive shaft is provided. The apparatus comprises an adapter, an extension pole, and a tool head. The adapter has a drive shaft and a fluid passage. A first end of the adapter drive shaft is adapted to be coupled to the power source drive shaft. The adapter fluid passage is adapted to receive fluid flowing from a source of fluid and to permit flow of fluid there through. The extension pole has a drive shaft and a fluid passage. A first end of the extension pole drive shaft is adapted to be coupled to a second end of the adapter drive shaft. The extension pole fluid passage is adapted to receive fluid flowing from the adapter and to permit flow of fluid there through. The tool head is adapted to be coupled to the extension pole.

14 Claims, 5 Drawing Sheets

MULTI-PURPOSE EXTENDED REACH TOOL

Applicant hereby claims priority benefits under 35 U.S.C. §119(e) of U.S. Provisional Patent Application No. 61/397,383 filed Jun. 11, 2010, the disclosure of which is herein incorporated by reference.

BACKGROUND OF THE INVENTION

1. Technical Information

The present apparatus relates to multi-purpose tools in general, and to multi-purpose extended reach tools having a rotary drive shaft in particular.

2. Background Information

A variety of tools are necessary for the construction and maintenance of residential and commercial structures. In particular, a number of tools are necessary to clean or repair portions of a structure that are out of the reach of a user. In some instances, a tool is necessary to enable a user to clean or repair a portion of a structure that is at a significant height (e.g., a rain gutter). In other instances, a tool is necessary to enable a user to clean or repair a portion of a structure that is hard to reach (e.g., the interior of a downspout).

A number of the tools necessary for the construction and maintenance of residential and industrial structures utilize a motor-driven rotary drive shaft. A power drill, for example, includes a motor-driven rotary drive shaft to drive a cutting tool, or other implement. A disc sander is another example of a tool having a motor-driven rotary drive shaft. Such tools are typically adapted as powered hand tools, and therefore have very limited reach. Also, powered hand tools can be expensive, and thus it may be cost prohibitive for a user to own a plurality of such tools.

A number of the tools necessary for the construction and maintenance of residential and industrial structures are operable to deliver water or other fluids (e.g., paint, bug spray). A hose with a nozzle, for example, can be used to deliver fluid at a relatively high pressure. Like hand tools, the hose suffers from limited reach.

What is needed, therefore, is an apparatus that can be used to extend the reach of a powered hand tool, and one that can deliver fluid or other fluids over an extended distance.

SUMMARY OF THE INVENTION

According to one aspect of the present invention, a multi-purpose apparatus adapted to be coupled to a power source having a motor-driven rotary drive shaft is provided. The apparatus comprises an adapter, an extension pole, and a tool head. The adapter has an internal drive shaft and an internal fluid passage. A first end of the adapter drive shaft is adapted to be coupled to the power source drive shaft. The adapter fluid passage is adapted to receive fluid flowing from a source of fluid and to permit the flow of fluid there through. The extension pole has an internal drive shaft and an internal fluid passage. A first end of the extension pole drive shaft is adapted to be coupled to a second end of the adapter drive shaft. The extension pole fluid passage is adapted to receive fluid flowing from the adapter fluid passage and to permit the flow of fluid there through. The tool head is adapted to be coupled to the extension pole.

These and other features and advantages of the present invention will become apparent in light of the drawings and detailed description of the present invention provided below.

DETAILED DESCRIPTION OF THE INVENTION

Figure 1:
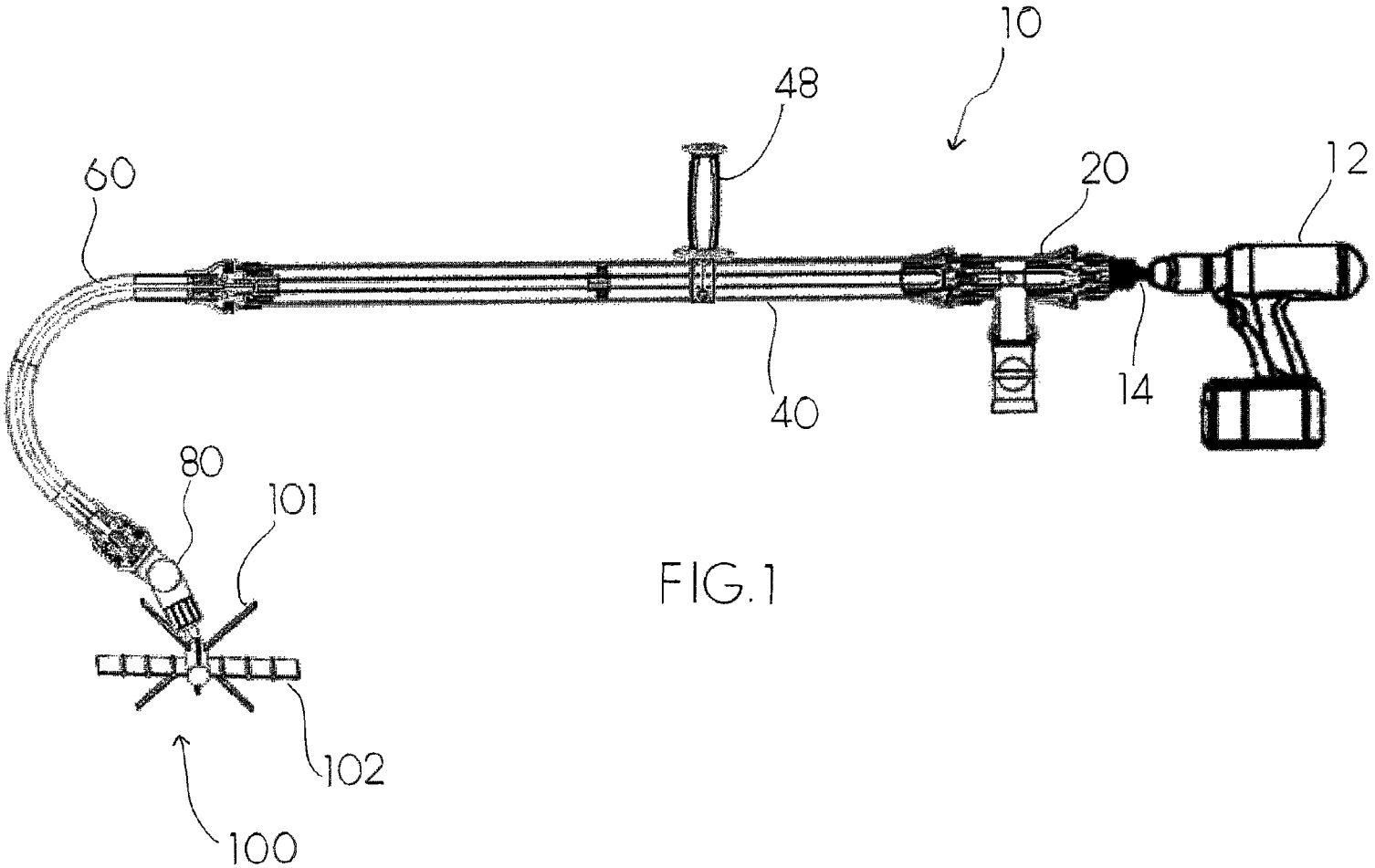
FIG. 1 is a diagrammatic representation of the present apparatus.

Referring to FIG. 1, an embodiment of the multi-purpose apparatus 10 is shown that includes an adapter 20, an extension pole 40, a curved pole section 60, a gear drive 80 and a tool head 100. The apparatus 10 is adapted to be coupled to a power source 12 having a motor-driven rotary member 14. The rotary member 14 may, for example, be a shaft or a chuck operable to clamp a shaft. Examples of power sources 12 that may be used with the present apparatus 10 include a power drill, a powered rotary driver, etc. The power source 12 may be powered by an electrical source (e.g., a battery), or by an internal-combustion engine. In all embodiments, the power source 12 is capable of producing sufficient torque on the rotary member 14 to drive the tool head 100. As will be discussed further below, any one of a number of attachable tool heads 100 may be used.

Figure 2:
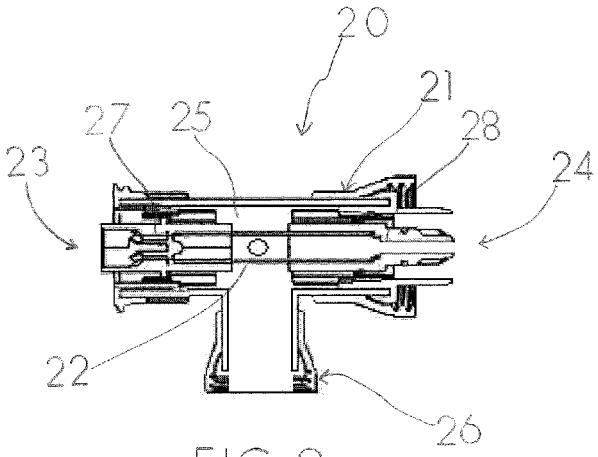
FIG. 2 is a cross-sectional view of an embodiment of the adapter.

Referring to FIG. 2, an embodiment of the adapter 20 is illustrated that includes a housing 21 and an internal drive shaft 22. The housing 21 includes a first end 23, a second end 24, an internal cavity 25 and an inlet port 26. The adapter drive shaft 22, which is rotatably mounted within the internal cavity 25 of the housing 21, includes a first end 27 and a second end 28. The first end 27 of the adapter drive shaft 22 is adapted to be coupled to the power source drive member 14 to permit the transfer of torque from the power source drive member 14 to the adapter drive shaft 22. A male/female spline connection between the power source drive member 14 and adapter drive shaft 22 is an example of an acceptable connection. For example, if the power source 12 is a drill (or other tool) having a chuck, a bit that includes a female spline socket could be secured within the chuck and positioned to receive the male splined end of the adapter drive shaft 22. The second end 28 of the adapter drive shaft 22 is adapted (e.g., by spline connection) to connect with the internal drive shaft 42 of an extension pole 40. The inlet port 26 is adapted to be coupled with a source of water or other fluid (e.g., paint, bug spray). For example, the inlet port 26 may comprise female screw threads for receiving the male screw threads of a garden hose. In the embodiment shown in FIG. 2, the adapter 20 is configured so that fluid entering the inlet port 26 passes through the internal cavity 25 and exits the adapter 20 through the second end 28 of the housing 21. To prevent leakage of fluid outside of the adapter 20, the adapter 20 may include seals (e.g., o-rings). In some embodiments (not shown), the adapter 20 further comprises a fluid passage 29 disposed within the internal cavity 25 of the housing 21. In such embodiments, the fluid passage 29 is adapted to receive fluid (i.e., from the inlet port 26) and to permit the flow of fluid there through.

Figure 3:
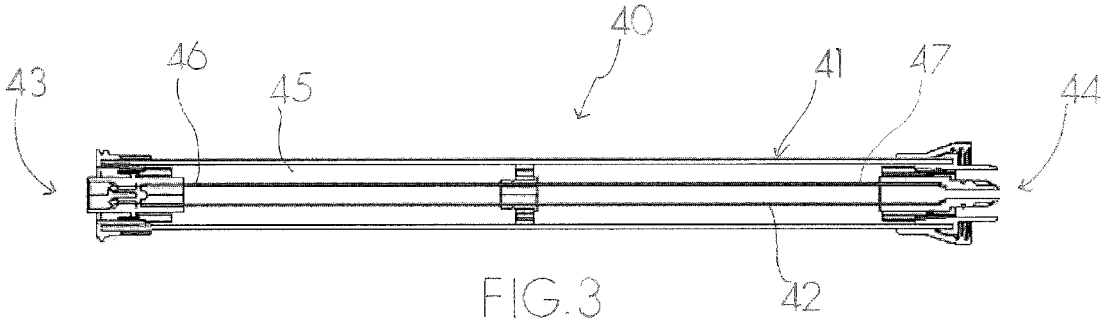
FIG. 3 is a cross-sectional view of an embodiment of the extension pole.

Referring to FIG. 3, an embodiment of the extension pole 40 is illustrated. The extension pole 40 includes a housing 41 and an internal drive shaft 42. The housing 41 includes a first end 43, a second end 44, and an internal cavity 45. The extension pole drive shaft 42, which is rotatably mounted within the internal cavity 45 of the housing 41, includes a first end 46 and a second end 47. The first end 46 of the extension pole drive shaft 42 is adapted to be coupled (e.g., by male/female spline connection) with the second end 28 of the adapter drive shaft 22, or with the drive, shaft 42 of another extension pole 40. The second end 47 of the extension pole drive shaft 42 is adapted to be coupled (e.g., by male/female spline connection) with the internal drive shaft 62 of a curved section 60, or with the internal drive shaft 82 of a gear drive 80, or with the internal drive shaft 42 of another extension pole 40, or with the drive shaft of a tool head. The extension pole 40 is adapted to receive fluid at its first end 41 (e.g., from the adapter 20), to permit the flow of fluid through its internal cavity 45, and to pass fluid to a subsequent "downstream" component (e.g., a curved section 60). The housing 41 is preferably made of a non-conductive, high strength material (e.g., fiberglass, PVC). The length of the extension pole 40 (i.e., the distance between the first end 43 and second end 44 of the housing 41) may vary to suit different applications. In some embodiments, a plurality of extension poles 40 can be connected to one another (e.g., by conventional fastening means such as clips, screwthread, etc.) within the apparatus 10 to provide additional reach. In some embodiments (see FIG. 1), a handle 48 can be affixed to the extension pole housing 41 to facilitate use of the apparatus 10. In some embodiments (not shown), the extension pole 40 further comprises a fluid passage 49 disposed within the internal cavity 45 of the housing 40. In such embodiments, the fluid passage 49 is adapted to receive fluid (e.g., from the adapter 20) and to permit the flow of fluid there through.

Figure 4:
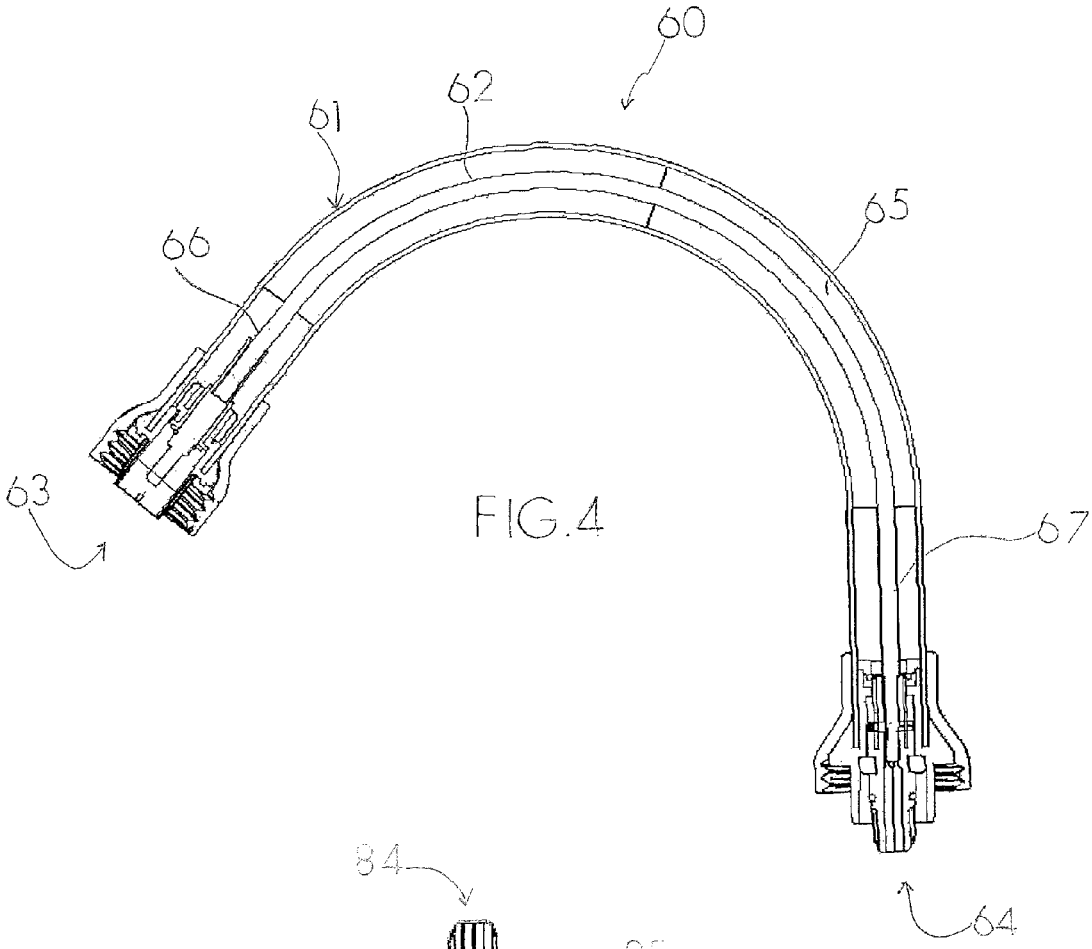
FIG. 4 is a cross-sectional view an embodiment of the curved section.

Referring to FIG. 4, an embodiment of the curved section 60 is illustrated that includes a housing 61 and an internal drive shaft 62. The housing 61 includes a first end 63, a second end 64, and an internal cavity 65. The curved section drive shaft 62, which is rotatably mounted within the internal cavity 65, includes a first end 66 and a second end 67. The first end 66 of the curved section drive shaft 62 is adapted to be coupled (e.g., by male/female spline connection) with the second end 67 of an extension pole drive shaft 62. The second end 67 of the curved section drive shaft 62 is adapted to be coupled (e.g., by male/female spline connection) with the internal drive shaft 82 of a gear drive 80, or with the drive shaft of a tool head. The curved section 60 is adapted to receive fluid at its first end 63 (e.g., from an extension pole 40), to permit the flow of fluid through its internal cavity 65, and to pass fluid to a subsequent "downstream" component (e.g., a gear drive 80). In some embodiments (not shown), the curved section 60 further comprises a fluid passage 68 disposed within the internal cavity 65 of the housing 61. In such embodiments, the fluid passage 68 is adapted to receive fluid (e.g., from the extension pole 40) and to permit the flow of fluid there through.

Figure 5:
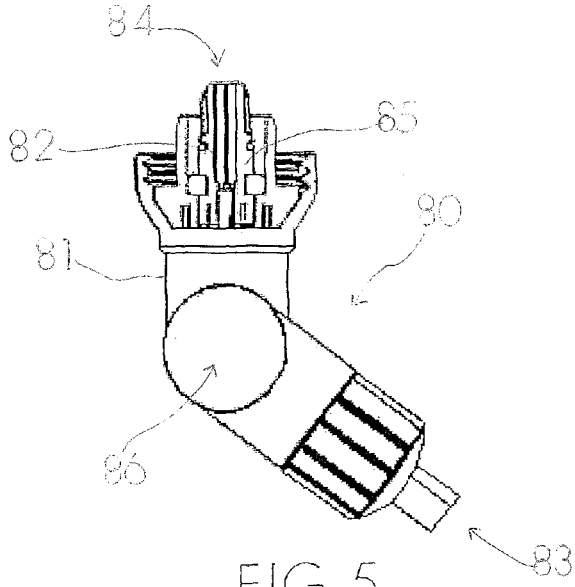
FIG. 5 is a diagrammatic view of an embodiment of the gear drive.

Referring to FIG. 5, an embodiment of the gear drive 80 is illustrated that includes a housing 81 and an internal drive shaft 82. The housing 81 includes a first end 83, a second end 84, and an internal cavity 85. The drive shaft 82 includes a first end 83 and a second end 84. The first end 83 is adapted to be coupled (e.g., by male/female spline connection) with the second end 67 of a curved section drive shaft 62, or with the second end 47 of an extension pole drive shaft 42. In the embodiment shown in FIG. 5, the gear drive 80 is pivotable about a center point 86 to enable adjustments between the angular positioning of the first and second ends 83, 84 of the drive shaft 82. The gear drive 80 may include internal gearing to facilitate the pivotable orientation of the first and second ends 83, 84 of the drive shaft 82. The gear drive 80 is adapted to receive fluid at its first end 83 (e.g., from the curved section), to permit the flow of fluid through its internal cavity 85, and to pass fluid to a subsequent "downstream" component (e.g., a tool head). In some embodiments (not shown), the gear drive 80 further comprises a fluid passage 86 disposed within the internal cavity 65 of the housing 81. In such embodiments, the fluid passage 86 is adapted to receive fluid (e.g., from the curved section 60) and to permit the flow of fluid there through.

As indicated above, connections between extension poles 40 can be accomplished by conventional fastening means such as clips, screw thread, etc. The connections between components within the apparatus 40 (e.g., between the adapter 20 and the extension pole 40, or between the extension pole 40 and the curved section 60, or between the curved section 60 and the gear drive 80, etc.) can also be accomplished by conventional fastening means such as clips, screw thread, etc. In preferred embodiments, some or all of the connections between components within the apparatus 10 share common type connectors to facilitate different configurations of the apparatus 10.

FIGS. 6-9 illustrate examples of tool heads that can be used with the present apparatus. Each tool head is operable to be coupled to the apparatus and is operable to perform particular functions. In some embodiments, the tool head includes internal structure for creating motion (e.g., rotary or reciprocal motion) and is adapted to be coupled to one or more of the gear drive 80, the curved section 60, or an extension pole 40 of the apparatus 10. For example, the tool head shown 100 in FIG. 1 includes a plurality of brushes 101 and a plurality of paddles 102 that can be rotatably driven. In other embodiments, the tool head includes structure that utilizes fluid power to perform a task; e.g., one or more spray nozzles. While the tool heads of the present invention are described only with respect to the embodiments illustrated in FIGS. 6-9, those skilled in the art will readily appreciate that various changes and/or modifications can be made to those embodiments without departing from the spirit or scope of the invention as defined by the appended claims.

Figure 6:
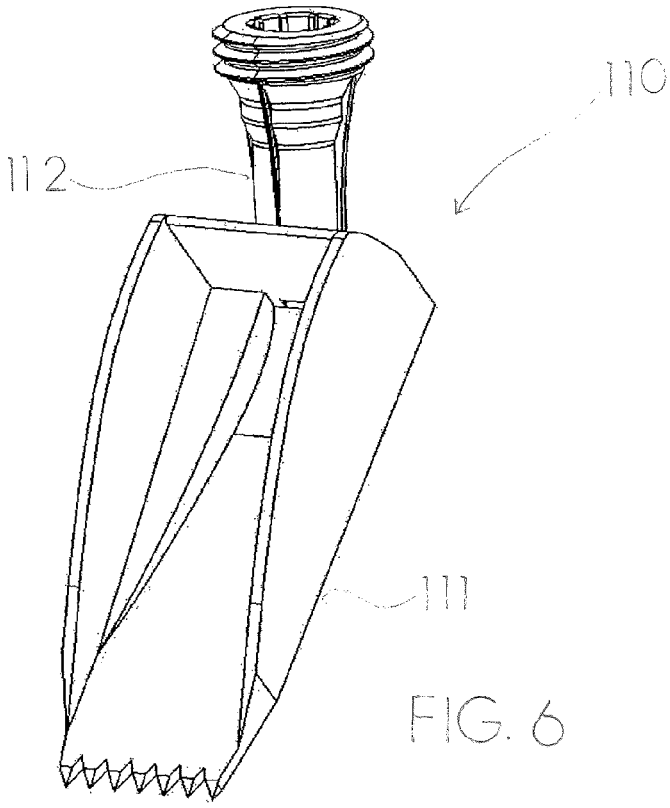
FIG. 6 is a diagrammatic representation of an embodiment of a tool head.

Referring to FIG. 6, a tool head 110 embodiment is illustrated. The tool head 110 includes a scoop portion 111 and a nozzle portion 112. The tool head 110 is adapted to be coupled (e.g., by male/female spline connection) to the gear drive 80, or to the curved section 60, or to an extension pole 40 of the apparatus 10. The scoop portion 111 is shaped and sized such that it is useful for scooping debris out of rain gutters. The nozzle portion 112 is adapted to receive fluid (e.g., from the gear drive 80), and to direct the fluid to the scoop portion 111 of the tool 110. The tool head 110 may be made of any high-strength, non-conductive material (e.g., plastic).

Figure 7:
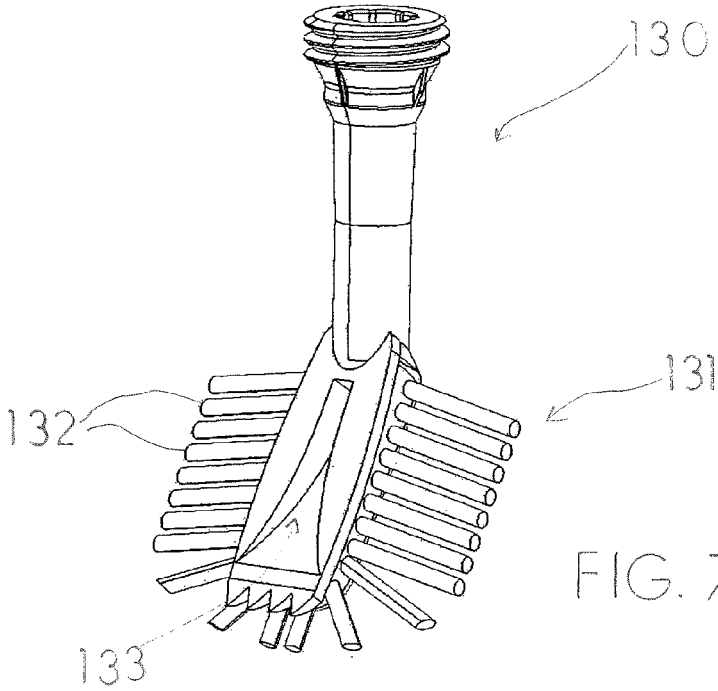
FIG. 7 is a diagrammatic representation of an alternative embodiment of a tool head.

Referring to FIG. 7, an alternative tool head 130 embodiment is illustrated. The tool head 130 includes a brush portion 131 having a plurality of bristles 132 and a plurality of fluid outlets 133. The tool head 130 is adapted to be coupled (e.g., by male/female spline connection) to the gear drive 80, or to the curved section 60, or to an extension pole 40 of the apparatus 10. The brush portion 131 is adapted to receive fluid (e.g., from the gear drive 80), and to direct the fluid to the plurality of fluid outlets 133. The tool head 130 may be made of any high-strength, non-conductive material (e.g., plastic).

Figure 8:
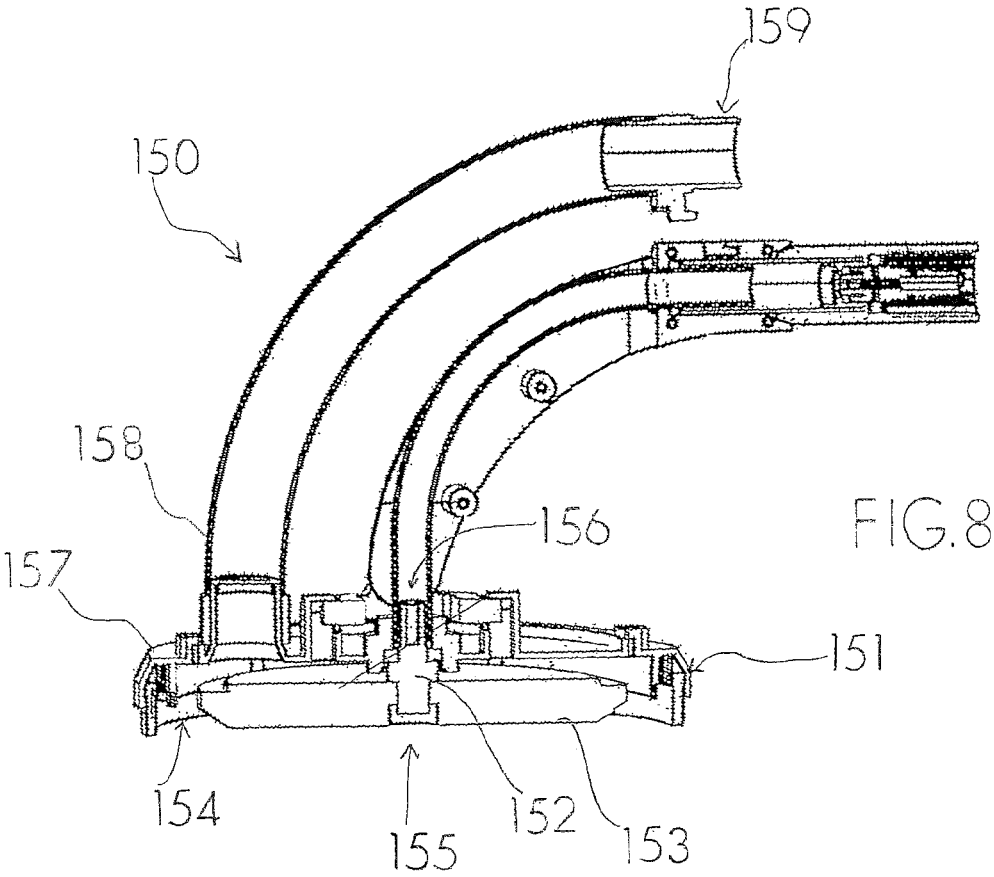
FIG. 8 is a cross-sectional view of an alternative embodiment of a tool head.
Figure 9:
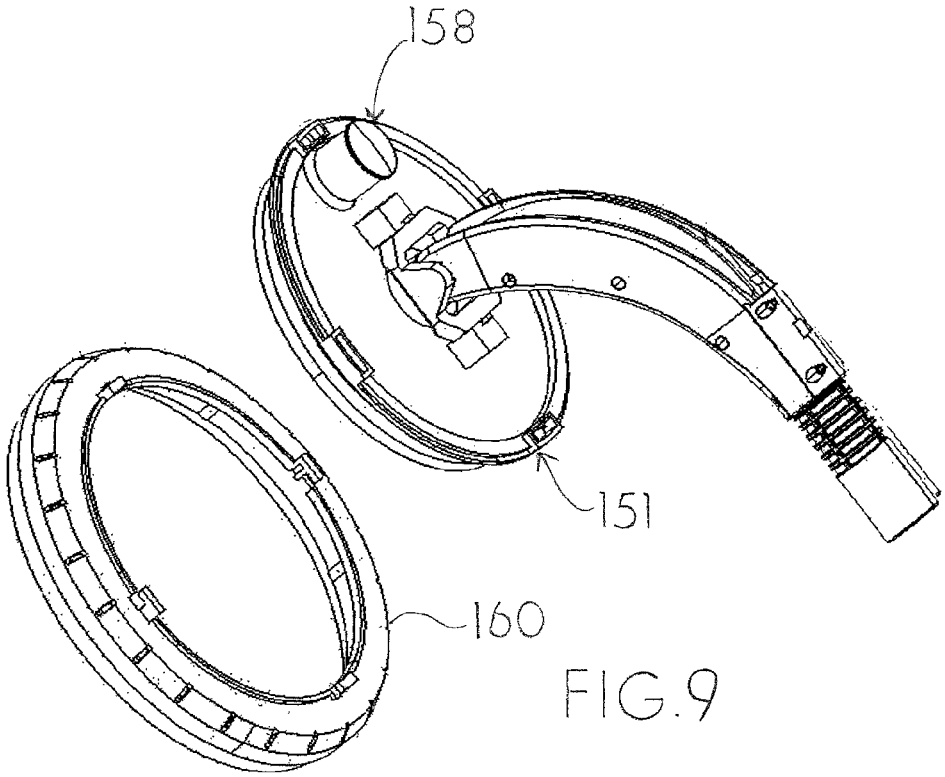
FIG. 9 is an exploded view of the tool head embodiment illustrated in FIG. 8.

Referring to FIGS. 8 and 9, an alternative tool head 150 embodiment is illustrated. The tool head 150 comprises a housing 151, a drive shaft 152 and a sanding disc 153. The housing 151 has a recess 154. The tool head drive shaft 152 has a first end 155 and a second end 156. The first end 155 of the tool head drive shaft 152 is adapted to be coupled (e.g., by male/female spline connection) to the gear drive 80, or to the curved section 60, or to an extension pole 40 of the apparatus 10. In the embodiment illustrated in FIG. 8, the first end 155 of the tool head drive shaft 152 is coupled to the drive shaft 152 of the gear drive 80. The second end 156 of the tool head drive shaft 152 is adapted to be coupled (e.g., by male/female spline connection) to the sanding disc 153. The tool head drive shaft 152 is adapted to be coupled to the apparatus 10 such that the rotary member 14 of the power source 12 is operable to rotationally drive the sanding disc 153. The sanding disc 153 is at least partially disposed within the housing recess 154. The housing 151 may further comprise an exterior 157 and a vacuum port 158. The vacuum port 158 extends from the recess 154 to the exterior 157 of the housing 151. Referring to FIG. 9, a vacuum 159 may be coupled to the vacuum port 158 in order to remove sanding particles from within the recess 154. In some embodiments (see FIG. 9), the housing 151 comprises a removable portion 160. In such embodiments, the removable portion 160, when removed from the housing 151, facilitates removal of the sanding disc 153 from the tool head drive shaft 152.

While the invention has been described with respect to preferred embodiments, those skilled in the art will readily appreciate that various changes and/or modifications can be made to the invention without departing from the spirit or scope of the invention as defined by appended claims.

What is claimed:

1. A multi-purpose apparatus adapted to be coupled to a power source having a motor-driven rotary drive shaft, the apparatus comprising:

an adapter having an internal drive shaft and an internal fluid passage, wherein a first end of the adapter drive shaft is adapted to be coupled to the power source drive shaft, wherein the adapter fluid passage is adapted to receive fluid flowing from a source of fluid and to permit the flow of fluid there through; and an extension pole having an internal drive shaft and an internal fluid passage, wherein a first end of the extension pole drive shaft is adapted to be coupled to a second end of the adapter drive shaft, wherein the extension pole fluid passage is adapted to receive fluid flowing from the adapter fluid passage and to permit the flow of fluid there through;

a tool head, adapted to be coupled to the extension pole; and a gear drive having an internal drive shaft and an internal fluid passage, wherein a first end of the gear drive drive shaft is adapted to be coupled to a second end of the extension pole drive shaft wherein the sear drive fluid passage is adapted to receive fluid flowing from the extension pole fluid passage and to permit the flow of fluid there through.

2. The apparatus of claim 1, further comprising:

a curved section having a flexible internal drive shaft and an internal fluid passage, wherein a first end of the curved section drive shaft is adapted to be coupled to a second end of the extension pole drive shaft, wherein the curved section drive shaft fluid passage is adapted to receive fluid flowing from the extension pole fluid passage and to permit the flow of fluid there through;

wherein the first end of the gear drive drive shaft is further adapted to be coupled to a second end of the curved section drive shaft, and wherein the gear drive fluid passage is further adapted to receive fluid flowing from the curved section fluid passage.

3. The apparatus of claim 2, wherein the adapter is coupled to the power source by a male/female spline connection, wherein the extension pole is coupled to the adapter by a male/female spline connection, wherein the curved section is coupled to the extension pole by a male/female spline connection, wherein the gear drive is coupled to the curved section by a male/female spline connection.

4. The apparatus of claim 1, wherein the extension pole is made of non-conductive, high strength fiberglass.

5. The apparatus of claim 1, wherein the adapter is coupled to the power source by a male/female spline connection, wherein the extension pole is coupled to the adapter by a male/female spline connection.

6. The apparatus of claim 1, wherein the tool head comprises:

a sanding disc; and a drive shaft;

wherein a first end of the tool head drive shaft is adapted to be coupled to a second end of the extension pole drive shaft, wherein a second end of the tool head drive shaft is adapted to be coupled to the sanding disc, and wherein the tool head drive shaft rotationally drives the sanding disc.

7. The apparatus of claim 1, wherein the tool head comprises:

a housing having a recess;

a drive shaft; and a sanding disc;

wherein a first end of the tool head drive shaft is adapted to be coupled to a second end of the extension pole drive shaft, wherein a second end of the tool head drive shaft is adapted to be coupled to the sanding disc, and wherein the tool head drive shaft is operable to rotationally drive the sanding disc;

wherein the sanding disc is at least partially disposed within the housing recess.

8. The apparatus of claim 7, wherein the housing further comprises an exterior and a vacuum port, wherein the vacuum port extends from the recess to the exterior.

9. The apparatus of claim 7, wherein a vacuum is adapted to be coupled to the vacuum port.

10. The apparatus of claim 1, wherein the tool head comprises:

a scoop portion; and a nozzle portion adapted to be coupled to the extension pole, wherein the nozzle portion is adapted to receive fluid flowing from the extension pole fluid passage and to direct the fluid to the scoop portion.

11. The apparatus of claim 1, wherein the tool head comprises:

a brush portion having a plurality of bristles and a plurality of fluid outlets, wherein the brush portion is adapted to receive fluid flowing from the extension pole fluid passage and to direct the fluid to the plurality of fluid outlets.

12. The apparatus of claim 1, wherein the tool head comprises:

a brush portion having a plurality of bristles and a plurality of fluid outlets; and a drive shaft;

wherein a first end of the tool head drive shaft is adapted to be coupled to a second end of the extension pole drive shaft, wherein a second end of the drive shaft is adapted to be coupled to the brush portion, wherein the drive shaft is operable to rotationally drive the brush portion, wherein the drive shaft is adapted to receive fluid flowing from the extension pole fluid passage and to direct the fluid to the plurality of fluid outlets.

13. A multi-purpose apparatus adapted to be coupled to a power source having a motor-driven rotary drive shaft, the apparatus comprising:

an adapter having an internal drive shaft and an internal fluid passage, wherein a first end of the adapter drive shaft is adapted to be coupled to the power source drive shaft, wherein the adapter fluid passage is adapted to receive fluid flowing from a source of fluid and to permit the flow of fluid there through; and an extension pole having an internal drive shaft and an internal fluid passage, wherein a first end of the extension pole drive shaft is adapted to be coupled to a second end of the adapter drive shaft, wherein the extension pole fluid passage is adapted to receive fluid flowing from the adapter fluid passage and to permit the flow of fluid there through;

a tool head, adapted to be coupled to the extension pole; and a curved section having a flexible internal drive shaft and an internal fluid passage, wherein a first end of the curved section drive shaft is adapted to be coupled to a second end of the extension pole drive shaft, wherein the curved section drive shaft fluid passage is adapted to receive fluid flowing from the extension pole fluid passage and to permit the flow of fluid there through.

14. A multi-purpose apparatus adapted to be coupled to a power source having a motor-driven rotary drive shaft, the apparatus comprising:

an adapter having an internal drive shaft and an internal fluid passage, wherein a first end of the adapter drive shaft is adapted to be coupled to the power source drive shaft, wherein the adapter fluid passage is adapted to receive fluid flowing from a source of fluid and to permit the flow of fluid there through, wherein the adapter fluid passage is adapted to receive fluid flowing from a garden hose; and an extension pole having an internal drive shaft and an internal fluid passage, wherein a first end of the extension pole drive shaft is adapted to be coupled to a second end of the adapter drive shaft, wherein the extension pole fluid passage is adapted to receive fluid flowing from the adapter fluid passage and to permit the flow of fluid there through; and a tool head, adapted to be coupled to the extension pole.

* * * * *